United States Patent [19]

Chapman et al.

[11] Patent Number: 5,058,515

[45] Date of Patent: Oct. 22, 1991

[54] BUTTON STITCHING APPARATUS

[75] Inventors: Walter F. Chapman, Chesterfield, Va.; Marc R. M. Arijs, Leeds, England

[73] Assignee: Automated Machinery Systems, Inc., Richmond, Va.

[21] Appl. No.: 362,244

[22] Filed: Jun. 6, 1989

[51] Int. Cl.[5] ..... D05B 3/12

[52] U.S. Cl. ..... 112/112; 112/115; 112/265.1

[58] Field of Search ..... 112/99, 108, 109, 110, 112/111, 112, 115, 178, 265.1, 267.1

[56] References Cited

U.S. PATENT DOCUMENTS

| | | | |
|---|---|---|---|
| 2,739,550 | 3/1956 | Patterson et al. | 112/110 |
| 2,811,939 | 11/1957 | Mirel | 112/108 |
| 3,125,046 | 3/1964 | Pedersen | 112/110 |

*Primary Examiner*—Werner H. Schroeder
*Assistant Examiner*—Paul C. Lewis
*Attorney, Agent, or Firm*—Staas & Halsey

[57] ABSTRACT

An arrangement for adjusting the operative position of a button stitcher tongue includes a detented sliding mechanism for adjusting the position of the tongue relative to a pivotal bottom cloth presser. The tongue includes a pivotal portion and a cam member which contacts the sliding adjustment mechanism when the tongue is in a button stitching position. The tongue also includes a jigger button slot.

7 Claims, 4 Drawing Sheets

BUTTON STITCHING APPARATUS

BACKGROUND OF THE INVENTION

I. Field of the Invention

This invention relates to devices for automatically stitching buttons onto articles of clothing.

II. Description of Related Art

A variety of devices are known in the apparel industry for automatically stitching buttons onto articles of clothing. Such devices have gained wide-spread acceptance and are considered essential to the mass production of most types of clothing having buttons.

For many applications, it is necessary only to sew the button flat against the clothing fabric. Such applications do not require much more than a basic sewing machine. However, certain types of clothing require a much more intricate button stitching process.

One such type of clothing is the traditional men's suit jacket. Buttons on suit jackets must first be sewn loosely to the jacket, after which the loose threads between the jacket fabric and the button are wrapped for strength.

In the case of buttons having holes through which the thread is passed in order to attach the button to the material, sewing and wrapping requires rotation of either the button or the needle during the stitching process, because the plane of the wrap is perpendicular to the plane of the attachment stitches. An example of a flat, four hole suit jacket button is shown in FIG. 7.

In addition, men's suits have traditionally required a higher quality of stitch, preferably approximating a hand-stitch. The appearance of the stitch on the inside of the jacket must be uniform. A tangle of threads, such as is produced by ordinary sewing machines, is unacceptable even on the inner side of the jacket.

A machine is commercially available which acceptably fulfills the tolerance requirements for men's suits. It operates by using a single needle and thread in a manner analogous to the needle and thread of a human seamster. The fabric is wrapped around a "tongue" in order to position the fabric in respect to the fabric, as shown in FIG. 2(*a*) and the needle is moved at right angles to the end of the tongue, penetrating the fabric to create a "blind" stitch which is not visible from the inside of the jacket.

The button is first located over the tongue in a plane perpendicular to the end of the tongue and parallel to the portion of the fabric to be stitched, which is wrapped over the end of the tongue. The single needle is driven into the fabric to anchor the attachment stitch, after which the button is rotated so that the holes in the button can be stitched, e.g., by moving the button under the control of a computer program so that the thread passes through selected holes therein according to a predetermined pattern.

In order to add a wrap stitch, the button is again rotated so that the plane of the button is substantially perpendicular to the principal plane of the tongue and parallel to the leading edge of the tongue (the right side of the tongue as shown in FIG. 2(*a*)), after which the threads leading from the button to the fabric are automatically wrapped and "lock" stitches are added to keep the thread from unraveling. In some cases, the wrapping step is omitted, especially in the case of suit jacket buttons which are intended to be decorative rather than functional.

All of the above steps may be easily initiated by an unskilled operator after selection of the desired stitch, the stitching steps being automatically performed under the control of a button stitcher control program.

However, intervention by a skilled operator is required in order to adjust the machine for different fabrics. It is crucial that the portion of the fabric to be stitched be precisely located in respect to the plane of movement of the needle, especially in the case of "blind" stiches. This is accomplished by adjusting the location of the end of the tongue nearest the needle, hereinafter referred to as the leading edge of the tongue.

Because of the way the fabric is folded over the leading edge of the tongue, the location of the tongue must be adjusted each time the fabric is changed. Such adjustment, using adjustment screws 11 as shown in FIG. 2(*a*), is both time-consuming and suffers from the disadvantage that a skilled operator is required to make the adjustment, whereas a rather lower level of skill is required simply to run the machine.

During stitching, the fabric must be held securely against the leading edge of the tongue, which means that the fabric should be pressed against both the top surface and the bottom surface of the tongue in order to hold it stationary against the leading edge and prevent excess loose fabric as, for example, in the case of a double-breasted suit, from interfering with movement of the stitching needle.

Although it is conventional to provide a "foot" for pressing the fabric against the top surface of the tongue, no means are currently available for securely pressing the fabric against the bottom of the tongue for maximum accuracy in holding the fabric against the leading edge of the tongue and out of the path of the stitching apparatus. Instead, the frame of the machine 8 serves to loosely support the fabric as shown in FIG. 2(*a*).

While the above-noted disadvantages, i.e., the need for adjustment when changing fabrics and the less than optimum holding of the fabric against the end of the tongue, have not prevented conventional button stitching machines from enjoying wide-spread popularity, the time and labor savings resulting from elimination of the necessity for adjustment for different fabric thicknesses, and the improved appearance that would result from better location of the fabric with respect to the leading edge of the tongue, could clearly produce significant commercial benefits. The present invention is a device which provides the above-noted benefits by an ingeniously simple attachment which can be retrofitted onto otherwise conventional button stitching machines.

SUMMARY OF THE INVENTION

It is an object of the invention to provide an attachment to a button stitching machine in which adjustment for different fabric thicknesses is precisely and quickly accomplished by simply moving a sliding adjustment mechanism into one of a plurality of detented positions, and which therefore does not require special skills to operate.

In a particularly advantageous embodiment, the number of detented positions is two, thus permitting rapid adjustment for the different thicknesses of single and double breasted suits.

It is a further object of the invention to provide a device for pressing the fabric to be stitched against the bottom of the tongue in order to help securely hold the fabric against the leading edge of the tongue, and which automatically adjusts itself for different fabric widths.

Finally, it is an object of the invention to provide a tongue which can be used to sew so-called "jigger" buttons onto a double breasted suit after attaching the regular buttons without the need for changing tongues.

These objects are accomplished by providing a tongue having two elongated members, one of which is slidably mounted for movement into and out of an operative position in the manner of a conventional tongue, and the other of which is pivotally mounted to the slidably-mounted member for pivoting into and out of one of a plurality of operative positions, each defining a precisely adjusted operative position for the leading edge of the tongue in respect to the plane of movement of the needle.

A plurality of operative positions of the tongue are defined by an adjustment mechanism having a stepped surface slidable in a direction transverse to the sliding direction of the slidably-mounted member and mounted on the slidably-mounted member, and which cooperates with a projection on teh pivotal member to define the vertical component of the position of the leading edge of the pivotal member in its operative position, depending on the position to which the adjustment member is slid. A cam surface on the pivotal member and a fixed projection attached to the frame of the stitching machine serves to define the horizontal component of the operative position of the leading edge.

In order to securely hold the fabric against the leading edge of the tongue and out of the path of the stitching apparatus during stitching, the fabric is pressed against the bottom surface of the tongue by a resiliently biased pivotal pressing member attached to the frame of the machine.

Finally, a jigger slot is provided in the tongue in order to permit attachment of a jigger button without the necessity for changing the tongue.

BRIEF DESCRIPTION OF THE DRAWINGS

FIGS. 2(*b*) and 2(*c*) show the manner in which the tongue shown in FIG. 1 is pivoted.

DESCRIPTION OF THE PREFERRED EMBODIMENT

Figure 1:
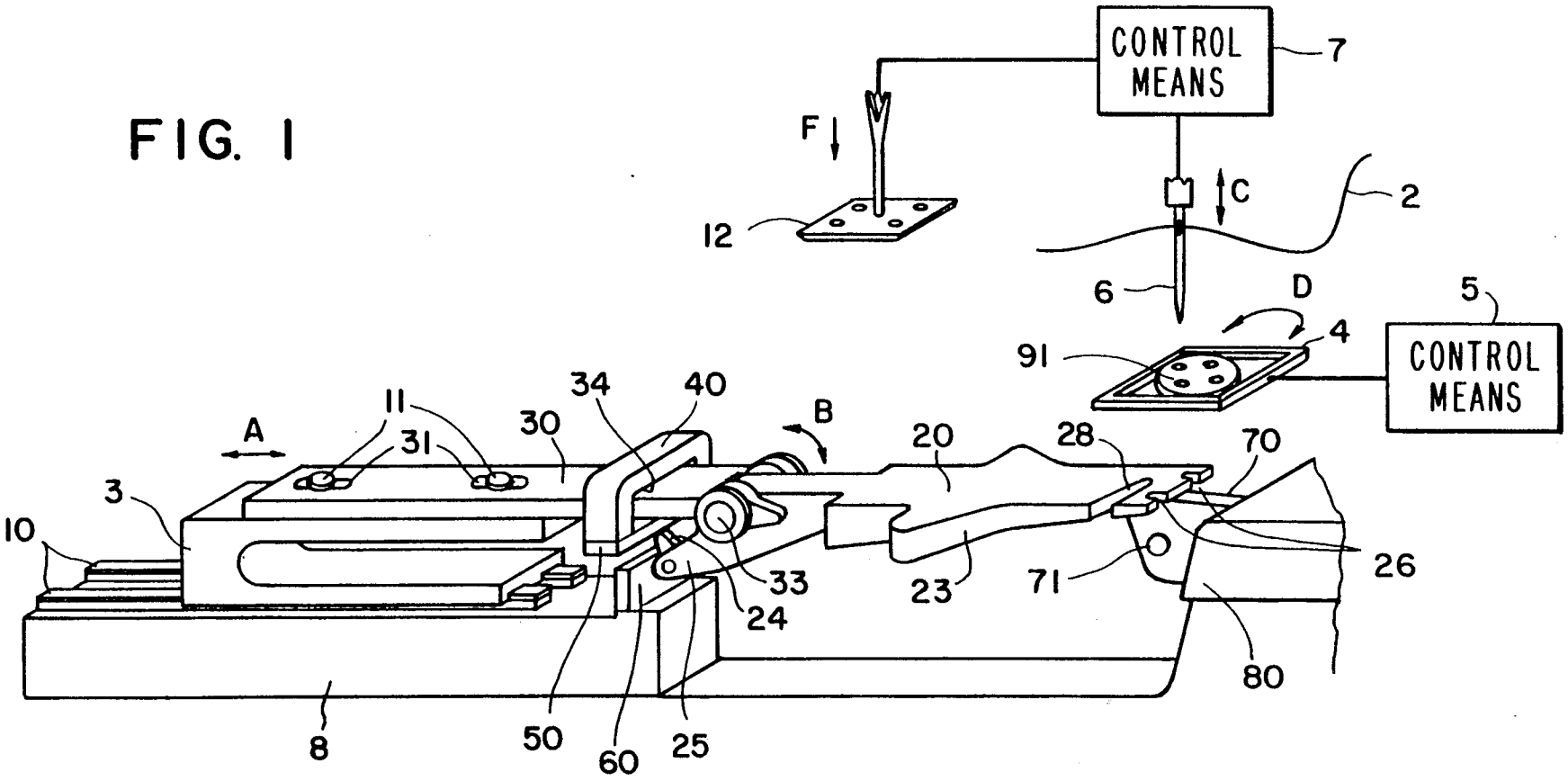
FIG. 1 is a perspective view showing a preferred embodiment of the invention and the manner in which it is mounted in a stitching machine.

FIG. 1 shows a perspective view of a preferred embodiment of the invention, including the manner in which a tongue of the preferred embodiment is mounted in a conventional button stitching machine. It should be noted that elements shown in FIG. 1 or any of the other drawings are not to be construed as being conventional unless specifically designated as part of the conventional machine to which the inventive device is attached.

The tongue of the preferred embodiment includes a slidably-mounted member 30 and a tongue member 20 pivotally connected to member 30 via pivot 33. The mounting of member 30 includes a mounting member 3 to which the tongue is adjustably mounted, and guiding members 10 on which member 3 is arranged for sliding in the direction of arrow A.

Figure 2C:
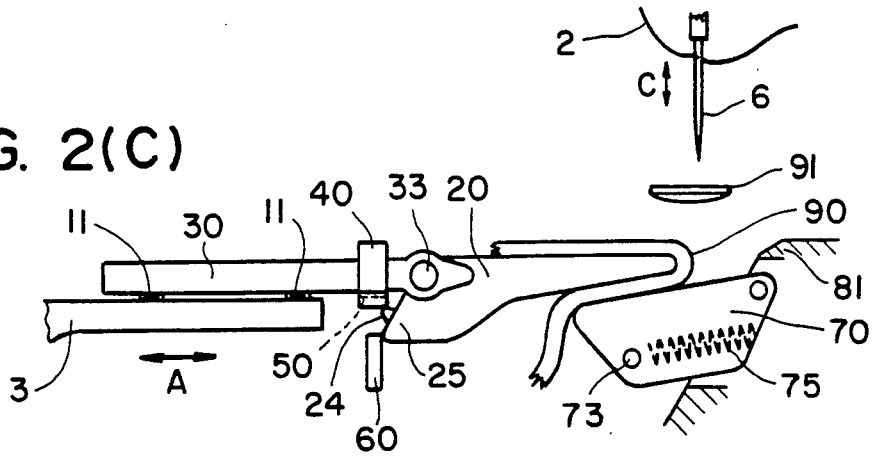
FIG. 2(*a*) illustrates a conventional, non-pivotal tongue.
Figure 2B:
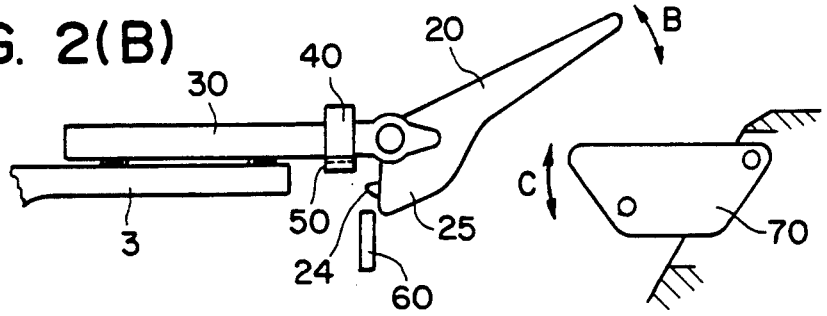
Figure 2A:
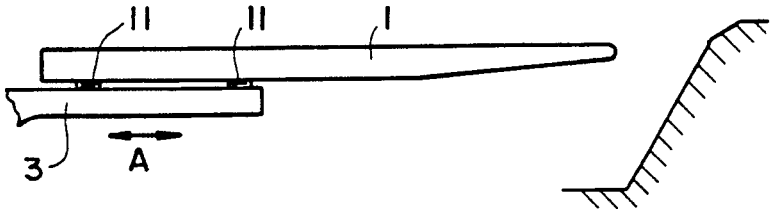
FIG. 2(A) PRIOR ART

The manner in which member 3 is slidably mounted to guide members 10, or to any functionally equivalent guide members, is conventional and may include such mechanical expedients as frictionless or lubricated bearing surfaces, rollers, or ball bearings. Member 3 is also provided in the conventional apparatus, as shown in FIG. 2(*a*).

A releasable latch (not shown) is provided to lock the member 3 in a position approximate the operative position of the tongue, which is essentially the position shown in FIG. 1. When released, the tongue assembly may be moved to the left under the influence of a bias spring (not shown) in order to withdraw the leading edge of the tongue away from the needle and button holding mechanism for the purposes of facilitating placement of the fabric around the leading edge of the tongue. Both the releasable latch and the bias spring are conventional.

When latched in the operative position, the tongue is positioned such that the needle 6 may enter one of slots 26 in the leading edge of the tongue under the control of control means 7. Control means 7 moves the needle 6 in the direction of arrow C, and possibly also in a plane parallel to the plane of the tongue for certain stitches and for positioning the needle 6 over a jigger slot, as will be explained below.

The tongue member 20 includes novel projections 23 for facilitating placement of fabric over the tongue and subsequent movement of the tongue into its operative position.

A foot 12 is either manually controlled or controlled by control means 7. Foot 12 is pressed downward during a stitching operation to clamp the material being stitched against the top surface of the tongue member 20. Such a foot is provided in most conventional button stitching machines.

Design of the control means 7 is essentially conventional and within the ability of the skilled mechanic. Included in the control means are motors, solenoids, air cylinders, or the like, for moving needle 6, devices for feeding thread 2, and programmable computer or logic devices for determining the magnitudes and directions of the movements caused by the respective motors and devices. A CRT panel display and keyboard may be used to provide an interface with the operator.

Movement and positioning of a button holder 4 is controlled by control means 5 which are similar to control means 7, including control of holder movement by a programmable logic control unit. In FIG. 1, the button holder 4 is shown in a position for loose attachment of the button to the fabric. The position of the fabric 90 in respect to button 91 is best shown in FIG. 2(*c*).

Figure 7:
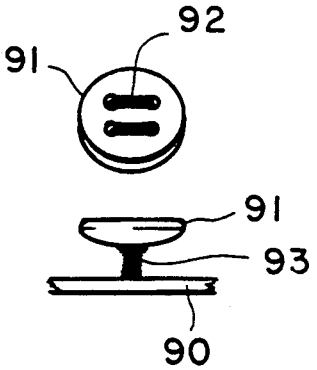
FIG. 7 is a top and side view of a button and the manner in which it is attached to the fabric of a jacket.

After attaching button 91 to fabric 90, the button is rotated by holder 4 as indicated by Arrow D so that wrapping can occur. A wrapped button is shown in FIG. 7, wherein reference numeral 92 designates the attachment stitch and reference numeral 93 designates the wrapping stitch which is wound around the attachment stitch.

It will be recognized by those skilled in the art that those buttons which do not have through-holes will not be rotated during stitching but rather will be held in a position parallel to the wrapping position throughout the stitching process.

An example of a presently used button stitching machine which includes control means similar to the above-mentioned control means 5 and 7 is the electronic button stitcher, Model No. 84-4 EBS, originally made by AMF Apparel Equipment.

The novel pivotal tongue of the preferred embodiment is attached to the mounting means 3 by adjustment screws 11 through apertures 31 in member 30. Apertures 31 are elongated in the direction of sliding for the purpose of initial calibration of a position of the leading edge of the tongue in its operative position. Once the position of the leading edge of the tongue has been initially calibrated, the screws are tightened and subsequent adjustments take place solely by manipulating the adjustment mechanism consisting of parts 40 and 50, to be described below.

In contrast, in conventional machines which have not been modified according to the preferred embodiment, the position of the tongue can be adjusted only by unscrewing screws similar to screws 11, sliding the tongue as permitted by the elongation of the apertures to a position determined by pain-staking measurement, and subsequently retightening the screws.

Figure 4:
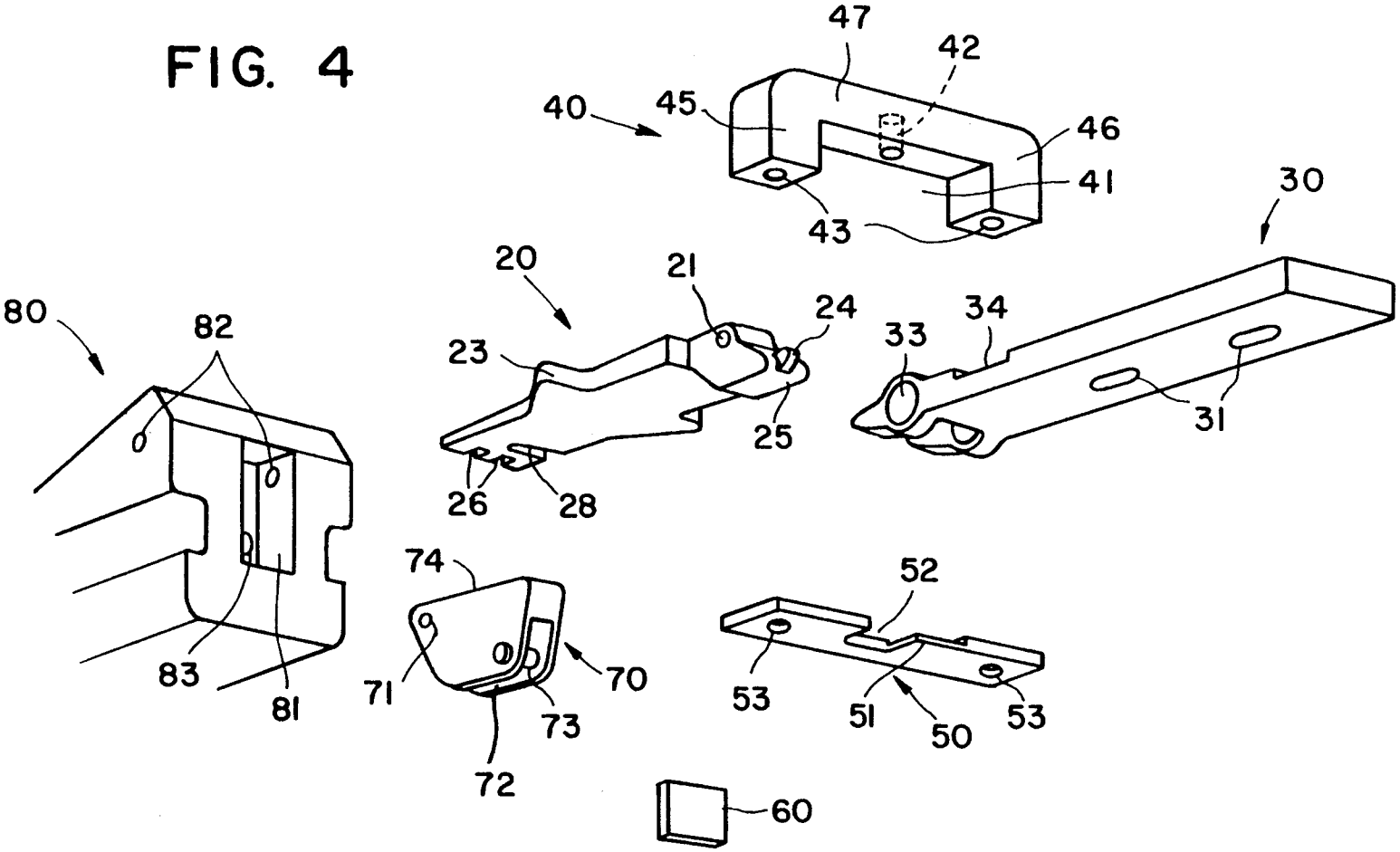
FIG. 4 is an exploded perspective view showing elements of the device of FIG. 1.

The adjustment mechanism includes two sliding members 40 and 50. As shown in FIG. 4, member 30 includes a groove 34, dimensioned such that the main body 47 of member 40 is slidable therein. Arms 45 and 46 of member 40 includes screw holes 43 which compliment screw holes 53 in member 50. Member 50 is placed on the opposite surface of member 30 from groove 34 and screwed to member 40 via screw holes 43 and 53.

Although fastening means other than screws may be used, screws are thought to be generally most convenient for purposes of the invention. The use of screws facilitates changing of plate 50, which controls the final operative position of the leading edge of the tongue.

Figure 5:
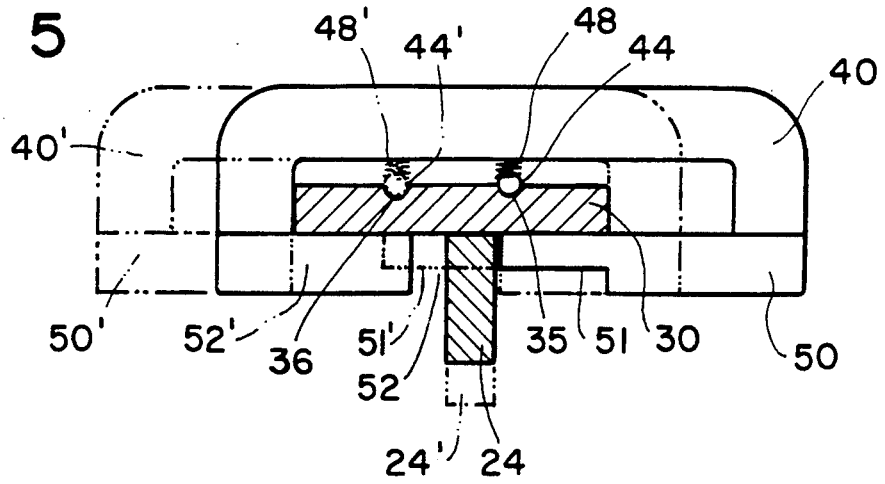
FIG. 5 is a cross-sectional view illustrating the manner in which the adjustment member shown in FIG. 1 operates.

Before attachment of member 40 to member 50, a detent is added to member 40 as shown in FIG. 5. The detent advantageously includes a coil spring 48 and spherical detent member 44. The coil spring is inserted in a hole 42 and is compressed upon assembly to bias the spherical member downward as shown in FIG. 5.

Member 30 includes semi-spherical indentations 35 and 36 symmetrically located on opposite sides of a central longitudinal axis of member 30, and located in groove 34. The downward bias of spring 48 causes the spherical member to cooperate with one of indentations 35 and 36 when located therein to hold the adjustment mechanism in place.

The spring constant of the spring 48 is chosen such that, when sufficient lateral pressure is brought to bear against member 40, member 40 can be slid along groove 34 to a detent position defined by either of indentations 35 and 36.

On the lower side of member 50, on the side opposite member 30, is a stepped surface having two levels 51 and 52 which cooperates with a projection 24 on pivotal member 20 to define the vertical component of the operative position of the leading edge of pivotal tongue member 30.

Each "step" of number 50 corresponds to one of the detent positions. Thus, in FIG. 5, projection 24 is shown in solid line as engaging step 52, which may actually be an opening in member 50 such that the projection rests on the lower side of number 30. At this time, the adjustment mechanism is detented by the cooperation of spherical member 44 and indentation 35.

When the adjustment mechanism is shifted to the left in FIG. 5 so that spherical member 44 engages indentation 36, however, step 51 cooperates with the projection 24 such that the projection rests at a lower position than the position controlled by step 52, thus raising the operative position of the leading edge of member 20. This position is shown in dashed line in FIG. 5. The elements of the dashed line representation of element 40 have been indicated by adding apostrophies or "primes" after the reference numerals, which are otherwise unchanged.

It will be appreciated that any number of indentations and corresponding steps may be provided so that a plurality of positions may be defined by the adjustment mechanism and stepped surface. Also, the position-defining step surface which cooperates with projection member 24 may take the form of a continuously sloped surface. Numerous other variations of the detent and position-defining means will undoubtedly occur to those skilled in the art based on the above description.

As is apparent from the drawings and above description, member 30 does not move during the process of adjustment. However, in order to slide the adjustment mechanism along groove 34, pivotal member 20 must be pivoted upwards to the position shown in FIG. 2(*b*) in order to allow projection 24 to clear both the steps and the bottom surface of member 50. Pivoting of the pivotal member 20 to the position shown in FIG. 2(*b*) also facilitates placement of fabric 90 around the leading edge of the tongue.

Figure 3:
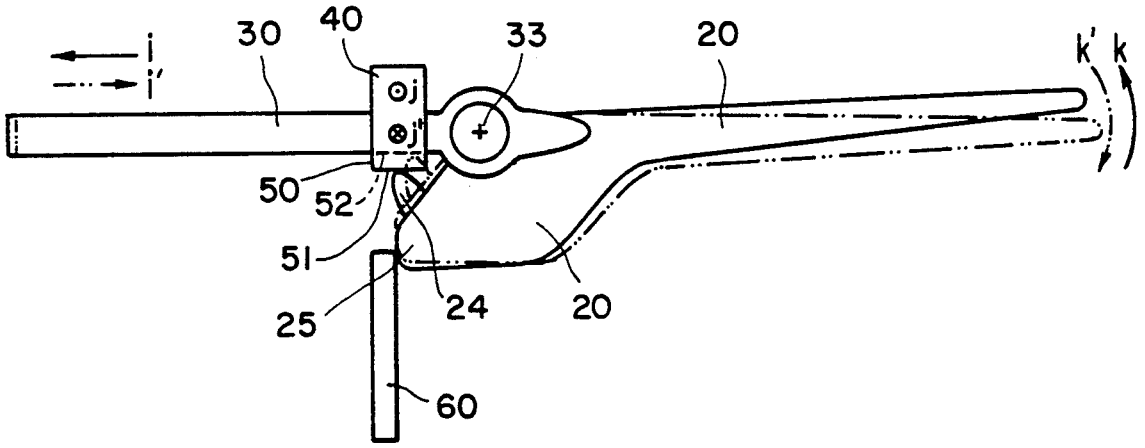
FIG. 3 is an enlarged side view showing the two operative positions into which the tongue of FIG. 1 can be pivoted.

FIG. 3 illustrates the two operative positions defined by steps 51 and 52 and also the manner in which the horizontal components of the operative positions are defined by the cooperation between a cam surface 25 on the pivotal member 20 and a fixed projection 60 fixedly connected in relation to the frame of the stitching machine.

As pivotal member 20 is pivoted downwards in the direction k' such that projection 24 contacts one of the two steps surfaces 51 or 52 (according to whether the adjustment mechanism consisting of members 40 and 50 have been slid in either the j or j' direction), the cam surface 25 contacts fixed number 60 to define the horizontal component of the operative position of the tongue.

Preferably, the pivoting movement of the member 20 is detented or biased in the operative downward position to prevent member 20 from pivoting in the direction of arrow k during operation of the stitching machine, and to hold the tongue in its operative position against leftward bias on member 30. An over-center spring (not shown) could be used to bias the pivotal member 20 in both its upward and downward positions.

Figure 6A:
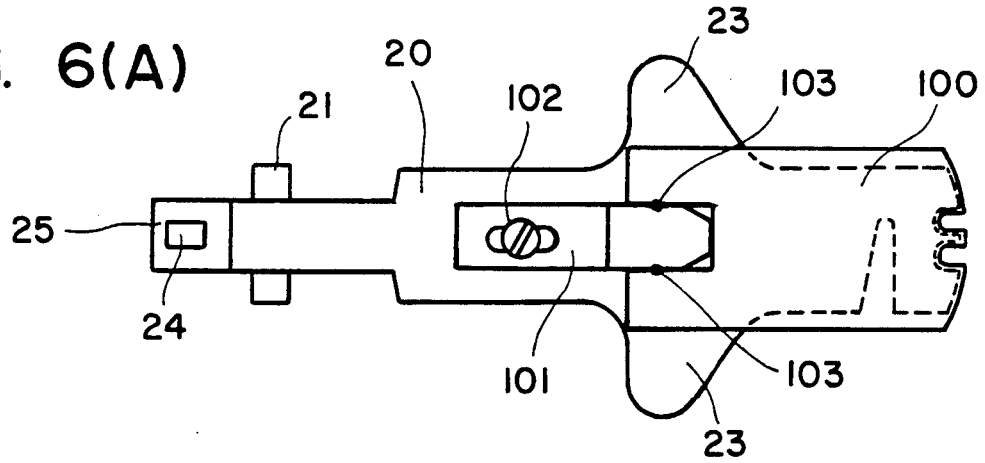
FIGS. 6(A) and 6(B) are a top view and a side view, respectively, of a modified pivotal tongue which permits additional adjustments to be made during a stitching operation.
Figure 6B:
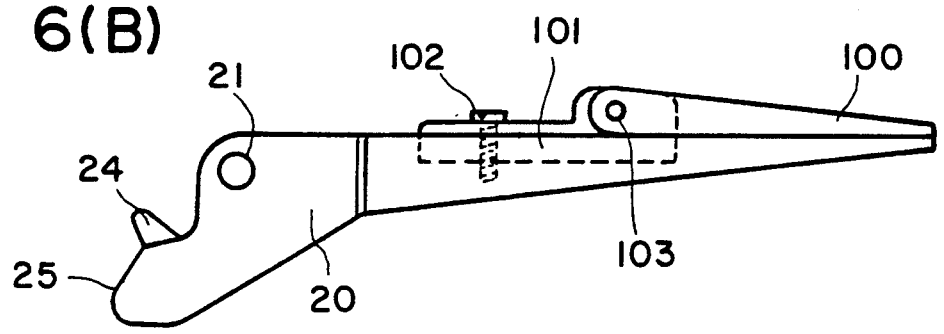

An additional adjustment which can be performed by an unskilled operator may be provided for by modifying tongue member 20 so that an additional tongue member 100 can be added to change the leading edge profile as shown in FIG. 6. Whenever needed, the additional member 100 is press fit onto a member 101 which is pre-attached to the pivotal tongue member 20 via screw 102. The press fit is indicated by reference numeral 103.

Now will be described the manner in which the fabric is pressed against the lower surface of the tongue so that the fabric will remain precisely located against the leading edge of the tongue during the stitching process:

A portion of frame 8, designated by the reference number 80, and which could be a discrete member fastened to the frame, includes a slot 81 and holes 82 which hold a pivot pin or pins (not shown). The pivot pin or pins fit in holes 71 to act as a pivot for pressing member 70, best shown in FIG. 4.

The provision of slot 81 is the only modification of an existing button stitching machine part which is necessary in order to retrofit the invention onto a conventional button stitching machine. As indicated, the tongue itself simply replaces a conventional non-pivotal tongue and is attached via the adjustment screws 11 which are normally used to attach a conventional tongue to the machine.

Pressing member 70 also includes a slot 72 and a pin 73 to which a bias coil spring 75 is attached in order to bias the pressing member upwards as shown in FIG. 2(*b*). Thus, pressing member 70 will always bear against the bottom of pivotal member 30 when it is in any of its operative positions, or against any intervening fabric to hold the fabric securely in position without the need for a special adjustment and despite any changes in fabric width.

It will of course be recognized by those skilled in the art that numerous alternative arrangements for biasing and mounting the member 70 may be substituted for the particular arrangement shown, which is purely exemplary in nature.

Finally, the pivotal tongue member 20 may include a jigger slot 28 for permitting the sewing of jigger buttons on double breated jackets without the necessity for changing the tongue in machines wherein the control means are set-up to accommodate the sewing of such jigger buttons, i.e., stitching machines in which the needle may be moved in a plane parallel to the tongue member. Because of the unique pressing member 70, and the adjustment mechanism, no other adjustments to the tongue need be made to accommodate the thinner jacket material in the area of the jigger button.

In order to operate a button stitcher using the improved adjustment mechanism of the preferred embodiment, the operator prepares the machine for operation in a conventional manner and then selects a tongue operative position by sliding the adjustment mechanism to one of the detented positions of the mechanism while the pivotal tongue member is in its upward position. The fabric is placed over the tongue and the tongue is pivotted downwards into its operative position, defined by the stepped portions of the adjustment mechanism. The foot is then lowered to hold the fabric against the top surface of the tongue, after which the machine is ready for the initiation of stitching.

To subsequently sew a jigger button, the foot and tongue are raised, the adjustment mechanism is moved to a new detented position if necessary, the tongue is lowered to its operative position, the foot is lowered, and the machine control is set to a jigger button position for controlling the needle.

In view of the above description, it will naturally be appreciated by those skilled in the art that numerous modifications of the described exemplary embodiment are possible, and, consequently, it is intended that the scope of the invention shall be limited solely by the appended claims, which follow.

I claim:

1. An arrangement for adjusting an operative position of a tongue of a button stitcher comprising:

means including an elongated tongue member for positioning a piece of fabric in respect to a stitching needle;

a movable member and means for mounting the movable member for movement along an axis;

means for pivotally connecting said tongue member to said movable member such that said tongue member is pivotal between a first position and one of a plurality of second positions; and adjustment means for selecting one of said plurality of said second positions, thereby defining an operative position of said tongue member in respect to said axis, wherein said adjustment means comprises:

an adjustment member mounted on said movable member for movement between a plurality of detented positions, one for each of said plurality of second positions; a projection connected to and pivotal with said tongue member; and means including surfaces on said adjustment member for defining the operative position by engaging said projection when said tongue member is in a position substantially parallel to said axis, movement of the adjustment member between said detented positions causing different surfaces to be presented for engagement with said projection, and the engagement between the projection and one of said surfaces occurring when said tongue member is in one of said plurality of said second positions corresponding to one of said surfaces, there being one surface for each second position.

2. An arrangement as claimed in claim 1, wherein a number of said plurality of said second positions is two.

3. An arrangement as claimed in claim 1, wherein said tongue member includes projection means extending laterally in respect to said axis for facilitating placement of fabric over said plurality of said tongue and movement of said tongue into one of said second positions by an operator of the button stitcher in preparation for stitching.

4. An arrangement as claimed in claim 1 wherein the direction of movement of said adjustment member is perpendicular to said axis.

5. An arrangement for adjusting an operative position of a tongue of a button stitcher, comprising:

means including an elongated tongue member for positioning a piece of fabric in respect to a stitching needle, said tongue member including a jigger button slot;

a movable member and means for mounting the movable member for movement along an axis;

means for pivotally connecting said tongue member to said movable member such that said tongue member is pivotal between a first position and one of a plurality of second positions; and adjustment means for selecting one of said plurality of said second positions, thereby defining the operative position of said tongue member in respect to said axis.

6. An arrangement for adjusting an operative position of a tongue of a button stitcher, comprising:

means including an elongated tongue member for positioning a piece of fabric in respect to a stitching needle;

a movable member and means for mounting the movable member for movement along an axis;

means for pivotally connecting said tongue member to said movable member such that said tongue member is pivotal between a first position and one of a plurality of second positions; and adjustment means for selecting one of said plurality of said second positions, thereby defining the operative position of said tongue member in respect to said axis, further comprising means including a cam surface on said pivotal tongue member and a projection fixedly mounted to a stationary portion of the button stitcher for cooperation to define the vector component of said operative position which is parallel to the direction of said axis.

7. An arrangement for adjusting an operative position of a tongue of a button stitcher, comprising:

means including an elongated tongue member for positioning a piece of fabric to a stitching needle;

a movable member and means for mounting the movable member for movement along an axis;

means for pivotally connecting said tongue member to said movable member such that said tongue member is pivotal between a first position and one of a plurality of second positions; and adjustment means for selecting one of said plurality of said second positions, thereby defining the operative position of said tongue member in respect to said axis, further comprising a pressing member and means for resiliently biasing said pressing member to press said fabric against a surface of said tongue when said tongue is in one of said plurality of said second positions, said pressing member being pivotally mounted to a stationary portion of the button stitcher.

* * * * *